US010155639B2

(12) United States Patent
Witczak et al.

(10) Patent No.: US 10,155,639 B2
(45) Date of Patent: Dec. 18, 2018

(54) ELEVATOR NOTICE SYSTEM

(71) Applicant: Otis Elevator Company, Farmington, CT (US)

(72) Inventors: Tadeusz Pawel Witczak, Bethel, CT (US); Jose Miguel Pasini, Avon, CT (US); Arthur Hsu, South Glastonbury, CT (US); David Ginsberg, Granby, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 35 days.

(21) Appl. No.: 15/176,994

(22) Filed: Jun. 8, 2016

(65) Prior Publication Data

US 2017/0355557 A1 Dec. 14, 2017

(51) Int. Cl.
*B66B 3/02* (2006.01)
*B66B 9/00* (2006.01)

(52) U.S. Cl.
CPC ..... *B66B 3/02* (2013.01); *B66B 9/00* (2013.01); *B66B 2009/006* (2013.01)

(58) Field of Classification Search
CPC ..... B66B 3/02; B66B 3/006; B66B 3/008; B66B 9/00
See application file for complete search history.

(56) References Cited

U.S. PATENT DOCUMENTS 3,740,709 A 6/1973 Savino
4,064,971 A 12/1977 Iwasaka et al.
5,042,620 A 8/1991 Yoneda et al.
5,329,076 A * 7/1994 Kameli ..... B66B 1/2408 187/383
6,065,570 A 5/2000 Friedli et al.
(Continued)

FOREIGN PATENT DOCUMENTS

CN 103523620 B 2/2016
EP 0403232 A2 12/1990
(Continued)

OTHER PUBLICATIONS

E-Motive Launches Evolution Range of Elevator Displays, E-Motive Display News, URL:<http://halmapr.com/news/emotive/2009/11/19/e-motive-launches-evolution-range-of-next-generation-elevator-displays/>, Nov. 2009, 5 pages.
(Continued)

*Primary Examiner* — Michael A Riegelman
(74) *Attorney, Agent, or Firm* — Cantor Colburn LLP

(57) ABSTRACT

An elevator notice system for an elevator system includes at least one hoistway defined by a structure having a plurality of areas with each area having at least one gate and at least one car in each of the at least one hoistway. At least one of the at least one gate is associated with a respective hoistway. The elevator notice system includes a controller and a programmable display. The controller is configured to control the display and track the current location and scheduled destination of each of the at least one car in each of the at least one hoistway. The programmable display includes a car identification portion displaying a car identification type associated with a specific car of the at least one car, and is configured to display at least a next area destination associated with the specific car.

13 Claims, 4 Drawing Sheets

(56) References Cited

U.S. PATENT DOCUMENTS

| | | | | |
|---|---|---|---|---|
| 6,257,373 | B1 * | 7/2001 | Hikita | B66B 1/2458 187/387 |
| 6,288,688 | B1 | 9/2001 | Hughes et al. | |
| 6,360,849 | B1 | 3/2002 | Hikita | |
| 6,439,349 | B1 * | 8/2002 | Smith | B66B 1/2458 187/247 |
| 6,672,431 | B2 * | 1/2004 | Brand | B66B 1/2458 187/247 |
| 6,997,288 | B2 | 2/2006 | Kakko et al. | |
| 7,021,429 | B2 | 4/2006 | Hikita | |
| 7,036,635 | B2 | 5/2006 | Rintala et al. | |
| 7,040,458 | B2 | 5/2006 | Forsythe et al. | |
| 7,156,211 | B2 | 1/2007 | Difranza et al. | |
| 7,987,947 | B2 * | 8/2011 | Christy | B66B 1/468 187/249 |
| 8,157,059 | B2 | 4/2012 | Takeuchi et al. | |
| 8,348,018 | B2 | 1/2013 | Kostka | |
| 8,434,599 | B2 * | 5/2013 | Wang | B66B 5/0031 187/249 |
| 8,688,664 | B2 | 4/2014 | Pineau et al. | |
| 9,365,392 | B2 * | 6/2016 | Jacobs | B66B 1/2466 |
| 2001/0035314 | A1 | 11/2001 | Yoshida et al. | |
| 2009/0057069 | A1 | 3/2009 | Boggess | |
| 2012/0168257 | A1 * | 7/2012 | Joyce | B66B 1/2458 187/247 |
| 2012/0267203 | A1 * | 10/2012 | Friedli | B66B 1/34 187/388 |

FOREIGN PATENT DOCUMENTS

| | | | | |
|---|---|---|---|---|
| EP | 1069065 | A1 | 1/2001 | |
| EP | 2253570 | A1 | 11/2010 | |
| GB | 2216683 | A * | 10/1989 | B66B 1/2458 |
| JP | 4388546 | B2 | 12/2009 | |
| JP | 5167118 | B2 * | 3/2013 | B66B 3/00 |
| WO | 0179101 | A2 | 10/2001 | |
| WO | 0225624 | A1 | 3/2002 | |
| WO | WO 0225624 | A1 * | 3/2002 | B66B 3/00 |
| WO | 2007061422 | A1 | 5/2007 | |
| WO | 2007108168 | A1 | 9/2007 | |
| WO | 12077863 | A1 | 6/2012 | |

OTHER PUBLICATIONS

TFT-LCD150 TFT-LCD Display Indicator, Elevator Equipment Limited, Stentorgate Ltd., 2006. URL:<http://www.elevatorequipment.co.uk/home/section-2-lift-equipment/stentorgate-range-of-indicators-speech-units-call-registration-chimes/full-colour-tft-lcd-displays/full-colour-tftlcd-display-indicator-tftlcd150#JumpToOptionAnchor>, 2 pages.

Partial European Search Report from the European Patent Office for European Application No. 17174926.0; Date of Completion: Mar. 5, 2018; dated Mar. 15, 2018; 3 Pages.

* cited by examiner

ELEVATOR NOTICE SYSTEM

BACKGROUND

The present disclosure relates to an elevator system, and more particularly, to a notice system of the elevator system.

Elevator systems may include multiple elevator gates serving multiple floors of a building. Each gate may be associated with a hoistway that may contain at least one elevator car traveling between floors. Control systems of the elevator system strive to achieve optimal performance in getting passengers swiftly and efficiently to their destinations. However, current displays and call buttons may be confusing to some passengers and/or do not always provide a passenger with all the information one may like to have. It is desirable to provide programmable displays near landing doors and/or inside an elevator car that offer passengers an enhanced and/or unique elevator experience.

SUMMARY

An elevator notice system for an elevator system according to one, non-limiting, embodiment of the present disclosure wherein the elevator system includes at least one hoistway defined by a structure including a plurality of areas with each served area having at least one gate with at least one of the at least one gate associated with a respective hoistway, and at least one car in each of the at least one hoistways. The elevator notice system includes a controller configured to track the current location and scheduled destination of each of the at least one car in each of the at least one hoistway; and a programmable display including a car identification portion displaying a car identification type associated with a specific car of the at least one car and configured to display at least a next area destination associated with the specific car, and wherein the controller controls the display.

Additionally to the foregoing embodiment, the next area destination is the first of a plurality of successive area destinations displayed.

In the alternative or additionally thereto, in the foregoing embodiment, the at least one car is a plurality of cars.

In the alternative or additionally thereto, in the foregoing embodiment, the display includes a service indicator portion for selectively displaying at least one of an associated car not being in service and being an exit only car.

In the alternative or additionally thereto, in the foregoing embodiment, the display includes a service indicator portion for selectively displaying at least one of an associated gate not being in service and being an exit only gate.

In the alternative or additionally thereto, in the foregoing embodiment, the car identification type is one of a plurality of different car identification types that include at least one of a visual type, an audio type, and a haptic type.

In the alternative or additionally thereto, in the foregoing embodiment, the display is one of a plurality of displays with each display located proximate to each one of the at least one gate at each one of the plurality of areas.

In the alternative or additionally thereto, in the foregoing embodiment, the display includes an informative portion configured to selectively display no planned stops to a selected destination.

In the alternative or additionally thereto, in the foregoing embodiment, a car of the at least one car includes two doors with each door associated with a respective gate of the at least one gate.

An elevator system includes at least one hoistway defined by a structure including a plurality of levels with each served level having at least one gate with the at least one gate associated with a respective hoistway, and at least one car in each of the at least one hoistways. An elevator notice system of the elevator system includes a controller configured to track the current location and scheduled destination of each of the at least one car in each of the at least one hoistway; and a plurality of displays mounted to the structure, and each one of the plurality of displays associated with a respective gate and including a car identification portion displaying a car identification type associated with a specific car of the at least one car and a programmable gate identification portion displaying a gate identification associated with the respective gate of the at least one gate, and wherein the controller controls the display.

An elevator system according to another, non-limiting, embodiment includes first and second hoistways defined by a structure; first and second plurality of cars constructed and arranged to travel in the respective first and second hoistways; a plurality of areas in the structure and through which the first and second hoistways communicate; first and second gates located at each area and associated with the respective first and second hoistway; a display including a gate identification portion displaying a gate identification associated with the first gate and a car identification portion configured to selectively display a car identification type associated with a specific car of the first plurality of cars if the gate identification portion displays the first gate, and wherein the car identification portion is associated with the second plurality of cars if the gate identification portion displays the second gate; and a computer-based controller configured to control at least a portion of the display.

Additionally to the foregoing embodiment, the display includes a present car travel direction portion configured to display a direction of travel of the specific car.

In the alternative or additionally thereto, in the foregoing embodiment, the computer-based controller is configured to track the current location and scheduled destination of each of the first and second plurality of cars.

In the alternative or additionally thereto, in the foregoing embodiment, the display includes a car destination portion configured to display at least a next area destination associated with any one of the first and second plurality of cars associated with the respective first and second gates.

In the alternative or additionally thereto, in the foregoing embodiment, the display includes a service indicator portion for displaying at least one of an associated car not being in service and being an exit only car.

In the alternative or additionally thereto, in the foregoing embodiment, the car identification type is one of a plurality of different car identification types that include at least one of a visual type, an audio type, and a haptic type.

In the alternative or additionally thereto, in the foregoing embodiment, the display is one of a plurality of displays with each display located proximate to the respective first and second gates at each one of the plurality of areas.

In the alternative or additionally thereto, in the foregoing embodiment, the display includes an informative portion configured to selectively display at least one of passengers will be de-boarding, pet on-board, substantially full, and no planned stops to a selected destination.

In the alternative or additionally thereto, in the foregoing embodiment, the elevator system includes a second display proximate to the second gate, and wherein the display is a first display proximate to the first gate, and the first and second displays each include a gate dedication portion configured to selectively indicate at least one of exit only and gate out of service.

In the alternative or additionally thereto, in the foregoing embodiment, the plurality of areas is a plurality of floors The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
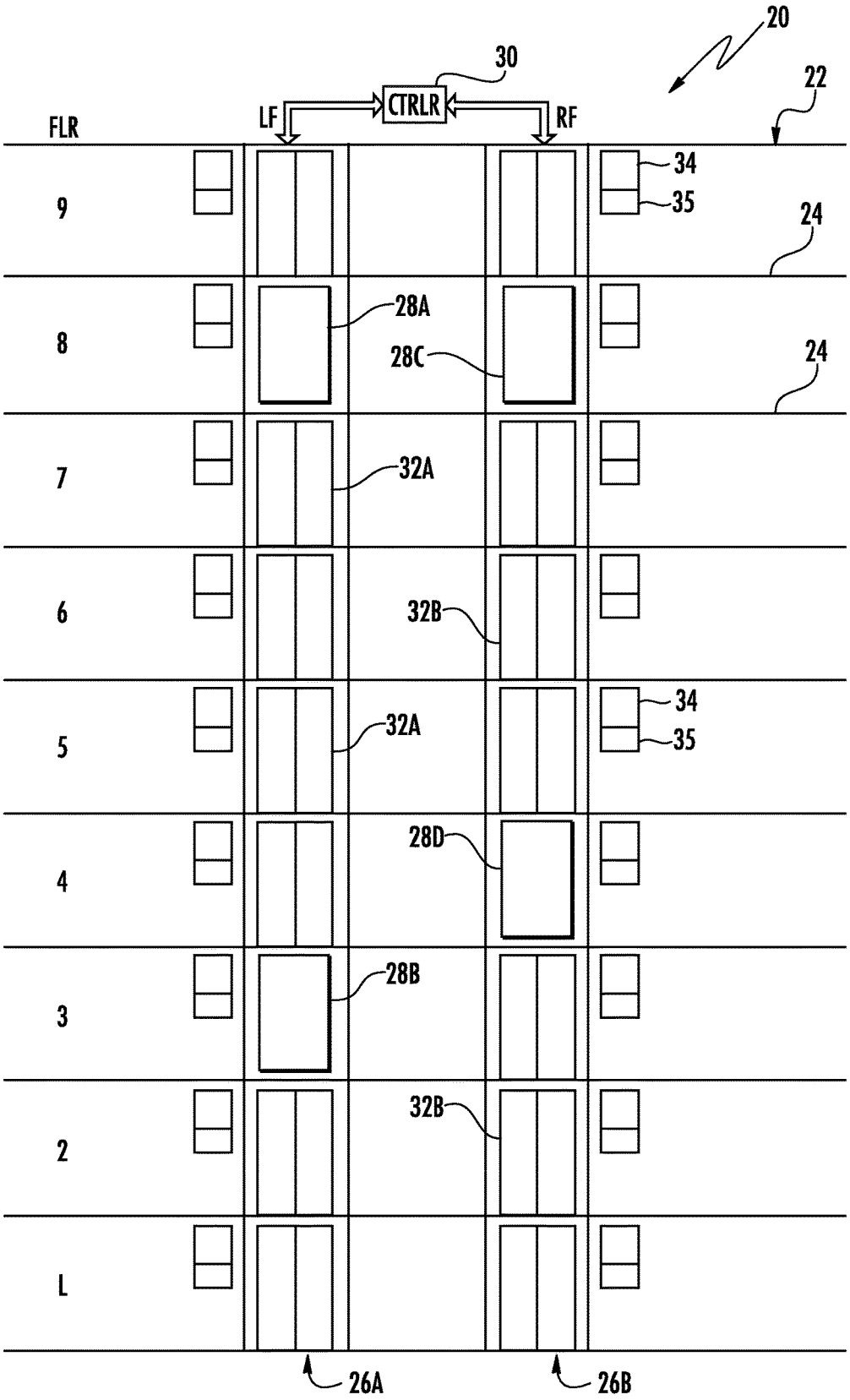
FIG. 1 is a schematic of an elevator system in an exemplary embodiment of the present disclosure.

FIG. 1 depicts an elevator system 20. In the exemplary embodiment of FIG. 1, elevator cars 28A, 28B, 28C, 28D (i.e., four illustrated as an example) may be self-propelled or ropeless (e.g., magnetic linear propulsion). In one embodiment, the elevator cars 28A, 28B, 28C, 28D may be propelled by a rope, hydraulics, or any other known propulsion system. The elevator system 20 is used in a structure or building 22 having multiple areas 24 (e.g., levels, floors, and others). Elevator system 20 includes at least one hoistway 26 (i.e., two illustrated and identified as 26A and 26B) having boundaries defined by the structure 22 and at least one car 28 (i.e., two illustrated in each hoistway 26) adapted to travel in the hoistway 26. A controller 30 of the elevator system 20 may generally control operation of the elevator cars 28A, 28B, 28C, 28D. For example, the controller 30 may designate specific car 28A for carrying and unloading passengers in an upward or downward direction only with the same car being in an express travel mode in the other direction (i.e., does not pick up or drop off passengers). In addition and upon a passenger request for travel to a specified floor, the controller 30 may be configured to choose which car 28A, 28B, 28C, 28D and in which hoistway (i.e., gate) the passenger will embark, thereby optimizing overall efficiency of the entire elevator system 20. Any variety of other operating parameters may also exist and may be monitored and/or controlled by the controller 30. It is contemplated and understood that the controller 30 may be configured to change a car identification type with regards to a specific car in certain elevator operation scenarios. It is further contemplated and understood that the hoistway(s) 26 may extend, and thus the cars 28 may travel, in a vertical direction, a horizontal direction, and/or a combination of both.

Figure 2:
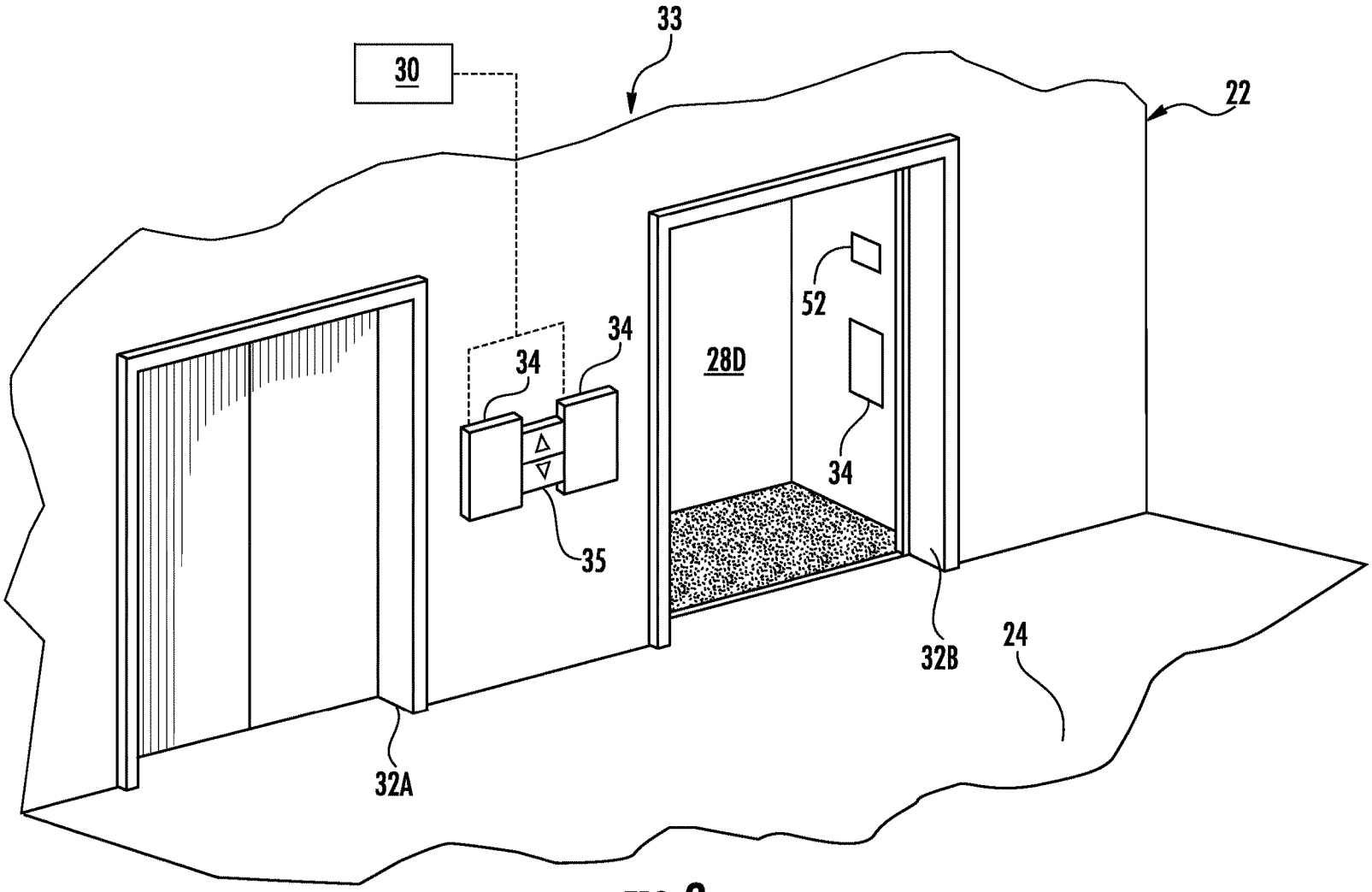
FIG. 2 is a partial perspective view of a floor of a building with two gates.

Referring to FIGS. 1 and 2, each floor 24 of the building 22 may support at least one gate or door 32. Each gate 32 may be associated with a specific hoistway 26. For example, a gate 32A may be located on each floor 24, which when open, grants access to one of cars 28A, 28B operating in hoistway 26A. Similarly, a gate 32B may be located at each floor 24 and when open may grant access to one of cars 28C, 28D operating in hoistway 26B. It is further contemplated and understood that an elevator car 28 may include two doors (i.e., front and back). In such an example, the two-doored elevator car may include two gates 32 at each level 24. Alternatively, there may be more than one gate 32 located at a particular floor 24 for a given hoistway 26. In such an example, there may be a separate gate identification for each gate at the same floor. For example, a front gate may be gate "B", while a rear gate may be gate "C". Both doors/gates may be configured to open at the same time, or the doors may open at different times to, for example, segregate traffic between two cars in the same hoistway. In this way, passengers waiting for two different cars in the same hoistway may not be crowded in front of the same gate for a particular hoistway.

The elevator system 20 may further include an elevator notice system 33 that may include the controller 30 and a plurality of displays 34 that may be programmable. The display 34 may be generally supported by the structure 22 and located at each gate 32 on each floor 22, in each car 28A, 28B, 28C, 28D, and/or any location that a perspective passenger may pass on the way to the elevator system 20. Alternatively, one display 34 may be located at each floor 22 and may be associated with any plurality of gates 32 at the specific level. Each display 34 may be controlled remotely by the controller 30, locally by a control unit integral with the display 34, or some combination thereof. The controller 30 may be a computer-based controller that may include a computer processor (e.g., microprocessor) and a computer readable and writeable storage medium. The display 34 may be an electronic display such as a flat screen (e.g., LCD screen) and/or an interactive touch screen, or any other display that may be programmable and electrically controlled by the controller 30. It is contemplated and understood that the display 34 may also be mounted to an elevator door or supported by a bay.

The elevator system 20 may further include a call button 35 located at each floor 24. The call button 35 may be operated by a waiting passenger on a specific floor 24 desiring to reach an upper or lower floor. Upon actuation of the call button 35, the controller 30 selects the optimal elevator car 28A, 28B, 28C, 28D for the passenger and provides an array of information on the display 34 that is relevant to the selection made by the passenger. The call button 35 may provide a waiting passenger the ability to select a desired floor 24 before boarding an elevator car or may simply provide the ability to select upward or downward travel. Such a call button arrangement may also assign a gate and car to the requesting passenger in order to direct the passenger to the assigned car to board. Additionally or in another embodiment, once a passenger is inside the selected elevator car 28B (for example), the passenger may select a desired floor from a panel (not shown) in the elevator car 28B. A display 34 inside the elevator car 28B may then display an array of information relevant to the associated gate, elevator car, and/or destination floor. It is contemplated and understood that the call button 35 may be an integral part of the display 34 which may be, or include, an interactive screen.

Figure 3:
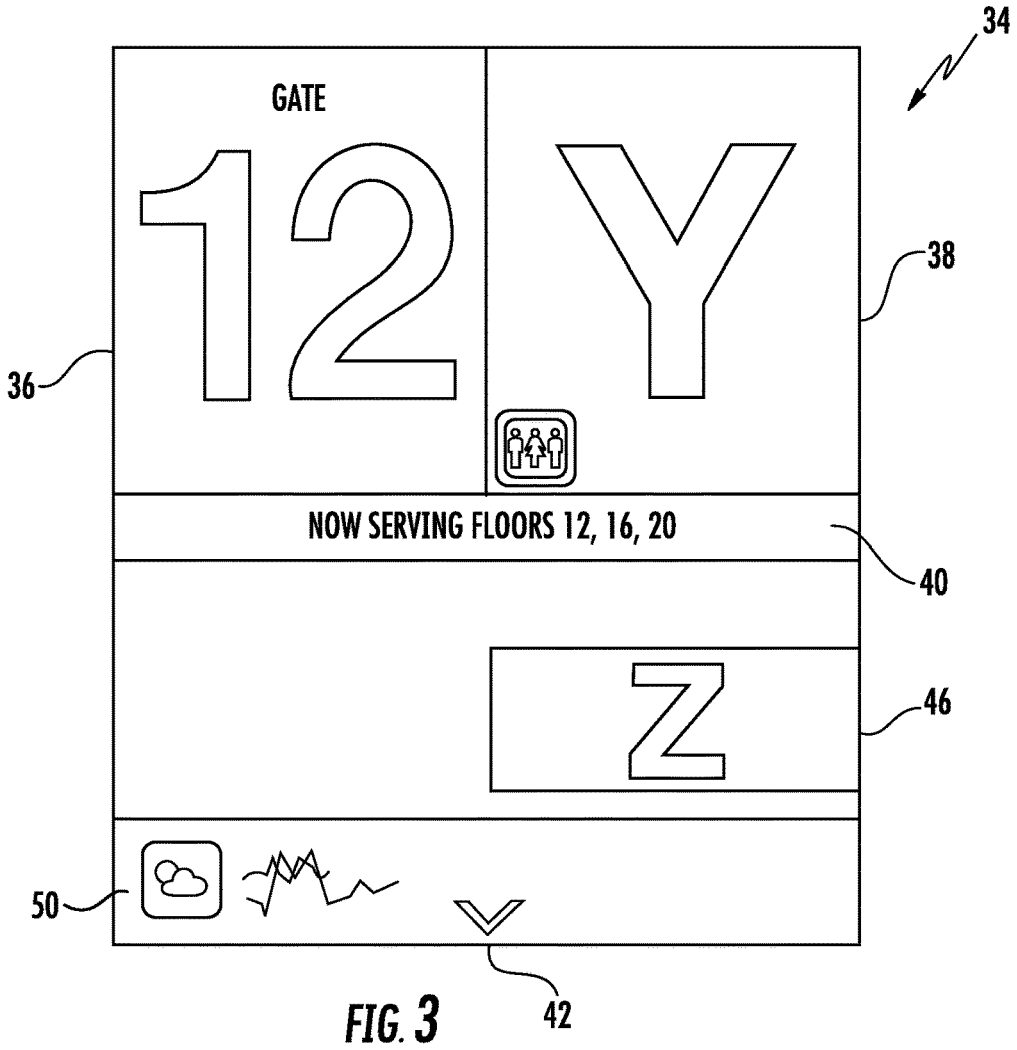
FIG. 3 is a front view of a display of an elevator notice system of the elevator system.
Figure 4:
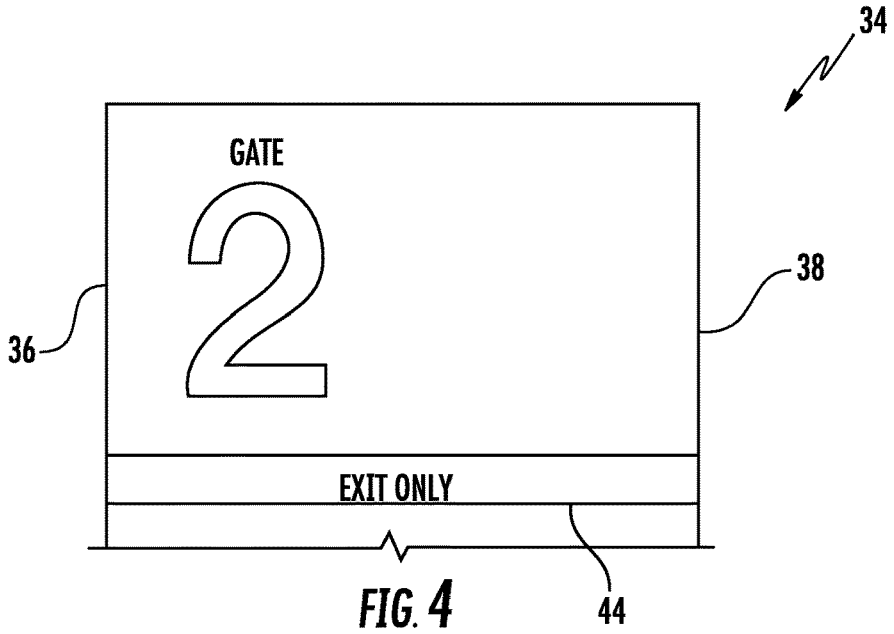
FIG. 4 is a partial front view of the display illustrating a gate dedication portion.

Referring to FIGS. 2 through 4, the display 34 may include a gate identification portion 36, a present car identification portion 38, a present car destination portion 40, a present car travel direction portion 42, a gate dedication portion 44 (see FIG. 4), a previous car information portion 46, and a general informative portion 50. The general informative portion 50 may be divided into segments with each segment providing additional information relative to the elevator car 28 identified in the present car identification portion 38. Such information that may be provided in portion 50 is in-part dependent upon the location of the display 34 (i.e., mounted at a floor or carried by an elevator car), and may include: passengers will be de-boarding from this car at your floor; pet on board; almost full; or, no planned stops to your destination. It is further contemplated and understood that any designated area upon an electronic screen of the display 34 may intermittently display different portions 36, 38, 40, 42, 44, 46, 48, 50 and/or may change screen configurations of the portions dependent upon where the display is being used and any interaction with a passenger.

The gate identification portion 36 displays the gate identification that may be directly associated with a specific hoistway (i.e., hoistway 26A or 26B). The present car identification portion 38 displays the specific car identification type that a passenger may be in or, otherwise, desires to travel in. In one embodiment where the display 34 is in an elevator car 28D, the gate and present car identification portions 36, 38 may remain constant. That is, unless the elevator car 28D is constructed and arranged to switch from hoistway 26B to hoistway 26A, the hoistway 26B (i.e. gate 32B) and the elevator car 28D that the passenger may be in will remain consistent. It is contemplated and understood that in embodiments where the gate identification and/or the elevator car identification type remain consistent, the gate identification portion 36 and the present car identification portion 38 may not be electronically displayed on an electronic screen segment of the display, and instead, may simply be static signage proximate to the screen.

In another embodiment, the display 34 may be mounted to a wall adjacent to each gate 32A, 32B. In this embodiment, and where there exist more than one elevator car 28A, 28B, 28C, 28D in a given hoistway 26A, 26B, the gate identification portion 36 may remain constant as previously described and the present car identification portion 38 may display the identification of the car that will be traveled in by the waiting passenger and/or the car that the present car destination portion 40, the present car travel direction portion 42, and/or the general informative portion 50 is providing information about. In addition, the present car identification portion 38 may notify waiting passengers that their assigned car may be the next to arrive. This information may be provided before the actual car arrives. It is further contemplated and understood that the display may be configured to display a plurality of cars assigned to arrive in an area and in a successive order. Similarly, if the display 34 is located in the car, the display may provide a plurality of areas (i.e., displayed all at the same time) that the car is scheduled to stop at and in a successive order.

Referring to FIG. 4, in another embodiment where the display 34 is located adjacent to each gate 32A, 32B on any given floor 24, the gate identification portion 36 may identify the gate, and the gate dedication portion 44 may provide information such as: this gate is used only for arrivals (i.e., exit only), this gate is not in service, this gate is a VIP gate, or other similar messages notifying a waiting passenger to generally disregard the gate for elevator travel. If gate 32A and/or gate 32B is so designated then the present car identification portion 38 may remain blank since no car can be chosen for a waiting passenger relative to the dedicated gate.

Figure 5:
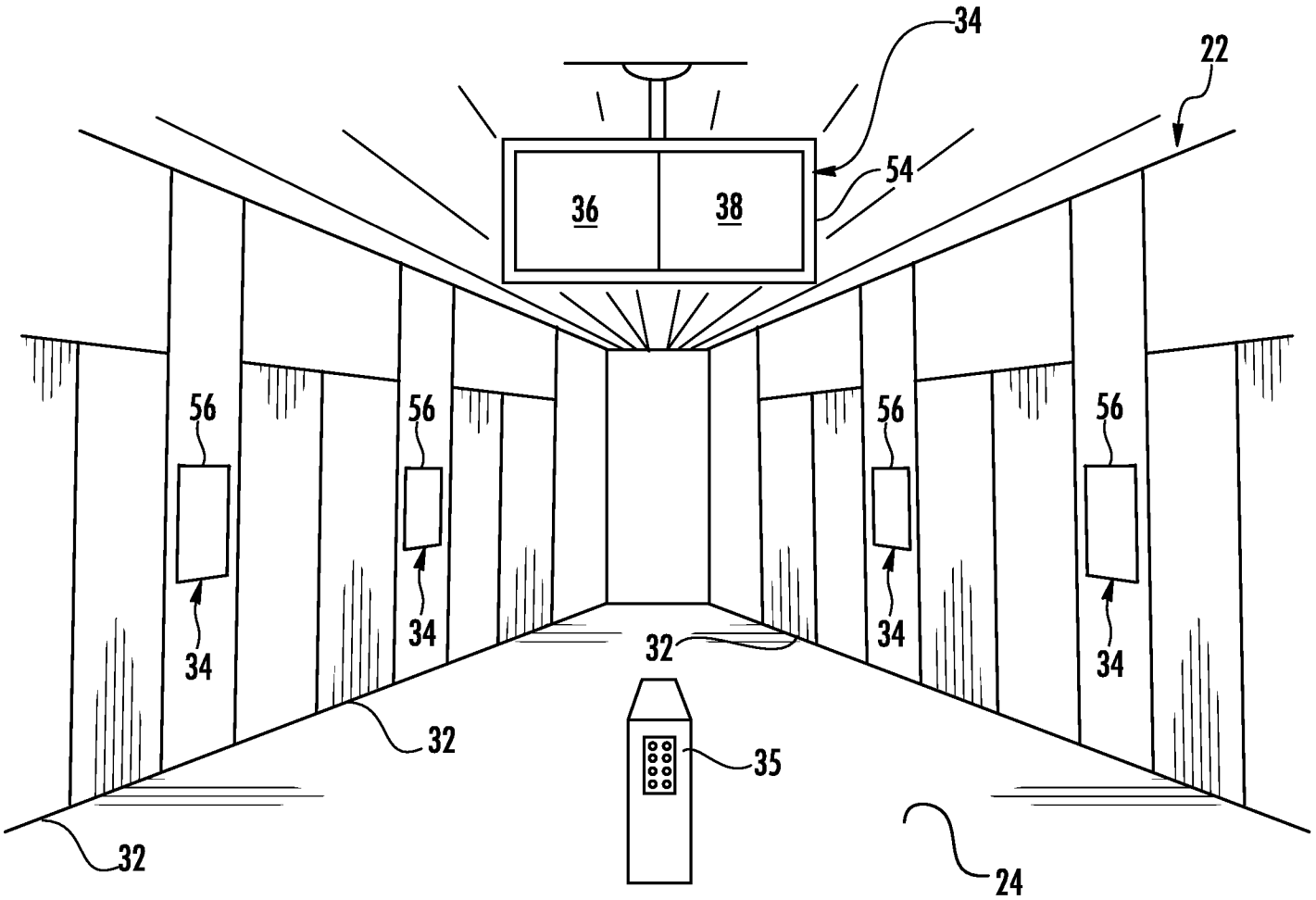
FIG. 5 is a perspective view of a lobby of the building illustrating a bank of gates of the elevator system utilizing the elevator notice system.

Referring to FIGS. 3 through 5, the display 34 may generally be divided (or redundant) and located at different physical locations on the same floor 24. For example, in a main lobby of the building 22, the call button 35 may be located at a substantial distance away from the gates 32A, 32B. Once a waiting passenger proximate to or in the lobby selects a desired floor 24, a part or separate subpanel 54 of the display 34 located proximate to the call button 35 may direct the waiting passenger to the appropriate gate, thus the gate identification portion 36 of the display 34 is proximate to the remote call button 35. In one example, when the waiting passenger is in front of the appropriate gate 32A, another part or subpanel 56 of the display 34, positioned adjacent to the gate, may direct the waiting passenger via the present car identification portion 38 to the appropriate car (i.e., car 28A or car 28B). From subpanel 56, the waiting passenger may also be provided information on where the controller selected car is presently located within the hoistway 26A, which direction the selected car is traveling, and other information relative to the selected car while the passenger waits to board. The subpanel 56 of the display 34 adjacent to the designated gate 32 may also provide the waiting passenger with information on whether the selected car has already departed (i.e., via the present car destination portion 40), thus providing the waiting passenger on whether re-entering a call is necessary. That is, the display 34 is able to provide negative confirmation to provide indication that someone is not waiting in the right area, such as the "exit door only" indication, a showing that a car just departed, and other such indications.

The subpanel 54 of the display 34 may be mounted or hung from a ceiling or mounted to other structures supported by the building 22. The subpanel 54 may be viewed as a master panel that directs waiting passengers to the correct gate 32 as a passenger convenience. That is, the passenger is not required to search for the correct gate and it minimizes any chance of a passenger boarding the wrong car through the wrong gate. The same subpanel 54 may also include the car identification portion 38, thus directing the waiting passenger on which car to board and at which gate. It is further contemplated and understood that either subpanel 54, 56 may include other portions of the display previously described. Yet further, graphical indicators (e.g., arrow pointing to the gate or a layout map) may be displayed to assist in directing passengers that view the display to their assigned gate.

It is further contemplated and understood that the car identification type may be a visual type, an audio type and/or a haptic type. The car identification type may be associated with a color, shape, and/or sound. In one embodiment, the car identification type may be an animation, and/or an experiential icon that may have alternative themes. For example, car identification type may be a plurality of types emitted, heard, or otherwise visualized at the same time or a particular order in time. In one embodiment, the car identification type may be audible tones, patterns of notes, timbre of sound and/or a verbalization (i.e., voice). The car identification type may be graphic themes (e.g., cartoon characters, animals, cities, and others).

In one example, a Bugs Bunny© icon may be shown at a kiosk and door display, and then a short Bugs Bunny clip may be shown in the elevator during the elevator ride. In this example, passengers may begin to anticipate the experience and, perhaps, look forward to it. Other themes might be city names (e.g., A for Athens, B for Berlin, C for Chicago, etc.) where once they are in the elevator car, the passengers may see cityscapes of the city projected, for example, on the elevator cab walls.

Benefits and advantages of the present disclosure include an improved user interface that minimizes passenger confusion, customizable features, and improved dispatching information. Improved dispatching efficiency is also provided since passengers are assigned to cars in hoistways which may have one or more cars in front of the assigned car stopping at the same floor.

While the present disclosure is described with reference to exemplary embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. An elevator notice system for an elevator system including at least one hoistway defined by a structure including a plurality of areas with each served area having at least one gate with at least one of the at least one gate associated with a respective hoistway, and a plurality of cars in each of the at least one hoistways, the elevator notice system comprising:

a controller configured to track the current location and scheduled destination of each of the at least one car in each of the at least one hoistway; and a programmable display including a car identification portion configured to display a car identification type associated with a selected specific car of the plurality of cars and configured to display at least a next area destination associated with the specific car, and wherein the controller controls the display, the next area destination is the first of a plurality of successive area destinations displayed, and the display is one of a plurality of displays with each display located proximate to each one of the at least one gate at each one of the plurality of areas.

2. The elevator notice system set forth in claim 1, wherein the display includes a service indicator portion for selectively displaying at least one of an associated car not being in service and being an exit only car.

3. The elevator notice system set forth in claim 1, wherein the display includes a service indicator portion for selectively displaying at least one of an associated gate not being in service and being an exit only gate.

4. The elevator notice system set forth in claim 1, wherein the car identification type is one of a plurality of different car identification types that include at least one of a visual type, an audio type, and a haptic type.

5. The elevator notice system set forth in claim 1, wherein the display includes an informative portion configured to selectively display no planned stops to a selected destination.

6. The elevator notice system set forth in claim 1, wherein a car of the at least one car includes two doors with each door associated with a respective gate of the at least one gate.

7. An elevator system comprising:

first and second hoistways defined by a structure;

first and second plurality of cars constructed and arranged to travel in the respective first and second hoistways;

a plurality of areas in the structure and through which the first and second hoistways communicate;

first and second gates located at each area and associated with the respective first and second hoistway;

a display including a gate identification portion displaying a gate identification associated with the first gate and a car identification portion configured to selectively display a car identification associated with a specific car of the first plurality of cars if the gate identification portion displays the first gate, and wherein the car identification portion is associated with the second plurality of cars if the gate identification portion displays the second gate; and a computer-based controller configured to control at least a portion of the display wherein the computer-based controller is configured to track the current location and scheduled destination of each of the first and second plurality of cars, and the display includes a car destination portion configured to display at least a next area destination associated with any one of the first and second plurality of cars associated with the respective first and second gates.

8. The elevator system set forth in claim 7, wherein the display includes a present car travel direction portion configured to display a direction of travel of the specific car.

9. The elevator system set forth in claim 7, wherein the display includes a service indicator portion for displaying at least one of an associated car not being in service and being an exit only car.

10. The elevator system set forth in claim 9, wherein the display is one of a plurality of displays with each display located proximate to the respective first and second gates at each one of the plurality of areas.

11. The elevator system set forth in claim 7, wherein the display includes an informative portion configured to selectively display at least one of passengers will be de-boarding, pet on-board, substantially full, and no planned stops to a selected destination.

12. The elevator system set forth in claim 7 further comprising:

a second display proximate to the second gate, and wherein the display is a first display proximate to the first gate, and the first and second displays each include a gate dedication portion configured to selectively indicate at least one of exit only and gate out of service.

13. The elevator system set forth in claim 7, wherein the plurality of areas is a plurality of floors.

* * * * *